US009564112B1

(12) United States Patent
Corbitt

(10) Patent No.: US 9,564,112 B1
(45) Date of Patent: Feb. 7, 2017

(54) INSTRUMENT CUSHION AND SUPPORT DEVICE

(71) Applicant: Lee W Corbitt, Ormond Beach, FL (US)

(72) Inventor: Lee W Corbitt, Ormond Beach, FL (US)

( * ) Notice: Subject to any disclaimer, the term of this patent is extended or adjusted under 35 U.S.C. 154(b) by 0 days.

(21) Appl. No.: 15/266,143

(22) Filed: Sep. 15, 2016

Related U.S. Application Data

(60) Provisional application No. 62/342,305, filed on May 27, 2016.

(51) Int. Cl.
*G10G 5/00* (2006.01)

(52) U.S. Cl.
CPC ..... *G10G 5/00* (2013.01); *G10G 5/005* (2013.01)

(58) Field of Classification Search
CPC ..... G10G 5/00; G10G 5/005
USPC ..... 84/327
See application file for complete search history.

(56) References Cited

U.S. PATENT DOCUMENTS 2,814,229 A * 11/1957 Vaccaro ..... G10D 3/003 84/280
3,407,695 A * 10/1968 Perlman ..... G10D 3/18 84/280
3,955,461 A * 5/1976 Ivie ..... G10G 5/00 84/327
3,979,993 A * 9/1976 Proctor ..... G10G 5/005 84/327
4,084,477 A * 4/1978 Dominguez ..... G10D 3/00 24/450
4,951,541 A * 8/1990 McMillan ..... G10D 3/18 84/280
5,208,409 A * 5/1993 Roulet ..... G10D 3/18 84/278
5,388,492 A * 2/1995 Olson ..... G10G 5/005 224/910
D410,669 S * 6/1999 Hamre ..... 84/327
6,031,167 A * 2/2000 Gaston ..... G10G 5/005 84/327
6,143,964 A * 11/2000 Chen ..... G10G 5/005 84/279
6,252,150 B1 * 6/2001 Johnson ..... G10G 5/005 84/327
6,259,007 B1 * 7/2001 Stuart ..... G10G 5/005 84/281
6,576,823 B1 * 6/2003 Wise, Jr. ..... G10G 5/005 84/327
7,205,468 B1 * 4/2007 Johnson ..... G10G 5/005 84/327
7,420,108 B1 * 9/2008 Block ..... G10G 5/005 84/327
7,732,689 B1 * 6/2010 Jiang ..... G10G 5/005 248/443

(Continued)

*Primary Examiner* — David Warren
*Assistant Examiner* — Christina Schreiber
(74) *Attorney, Agent, or Firm* — Jason T. Daniel, Esq.; Daniel Law Offices, P.A.

(57) ABSTRACT

An instrument cushion and support device includes a main body having a curved top surface, a curved bottom surface, a proximal end and a distal end. The main body includes a rigid central core and soft padding located between the curved top and bottom surfaces. A slip guard extends upward from the curved top surface of the main body at a location adjacent to the distal end, and a neck support extends upward from the top surface of the main body at a location adjacent to the proximal end.

6 Claims, 6 Drawing Sheets

(56) References Cited

U.S. PATENT DOCUMENTS

| | | | | |
|---|---|---|---|---|
| 2003/0217635 | A1* | 11/2003 | Christou | G10G 5/005 84/327 |
| 2007/0067914 | A1* | 3/2007 | Littlehorn | A47C 16/02 5/632 |
| 2009/0293702 | A1* | 12/2009 | Buettgen | G10D 9/00 84/387 A |
| 2012/0312144 | A1* | 12/2012 | Bibb | G10G 5/005 84/327 |
| 2015/0053061 | A1* | 2/2015 | Coglitore | G10G 5/005 84/327 |
| 2015/0290018 | A1* | 10/2015 | Okazawa | A45F 3/12 428/138 |

* cited by examiner

INSTRUMENT CUSHION AND SUPPORT DEVICE

CROSS-REFERENCE TO RELATED APPLICATIONS

This application claims the benefit of U.S. Application Ser. No. 62/342,305 filed on May 27, 2016, the contents of which are incorporated herein by reference.

TECHNICAL FIELD

The present invention relates generally to accessories for musical instruments, and more particularly to an instrument cushion and support device.

BACKGROUND

The statements in this section merely provide background information related to the present disclosure and may not constitute prior art.

Players of held musical instruments such as a guitar, for example, must be careful not to drop the instrument while playing. For this reason, most students learn to play the guitar in a seated position with the curved section of the guitar body resting on their leg. Moreover, advanced players often revert to this position as it is comfortable and allows prolonged play without tiring out the arm muscles of the player.

Unfortunately, depending on the weight and/or shape of the guitar body, it is not uncommon for users to experience discomfort in the leg where the guitar body rests for extended periods of time. This is because the surface area of the guitar making physical contact with the user is relatively small, therefore displacing the entire weight of the instrument onto a small portion of the users leg.

Additionally, many users must perform periodic maintenance on the instrument, such as replacing and/or tuning the strings, for example. When doing so, the guitar is typically placed onto a flat surface without any type of support along the delicate neck area. As such, it is not uncommon for the instrument to shift while being manipulated by the user, therefore causing undue frustration and/or possible damage to the instrument.

Accordingly, the present invention, directed to an instrument cushion and support device alleviates the above noted deficiencies and provides several benefits that were not previously available. The manner by which will become more apparent in the description which follows, particularly when read in conjunction with the accompanying drawings.

SUMMARY OF THE INVENTION

The present invention is directed to an instrument cushion and support device. One embodiment of the present invention can include a main body having a curved top surface, a curved bottom surface, a proximal end and a distal end. The main body can include a shape that is designed to rest on top of a user's thigh while in a seated position, and to receive a musical instrument. The main body can include a rigid central core and soft padding so as to disburse the weight of the musical instrument across a large area during use.

Another embodiment of the device can include a slip guard that extends upward from the curved top surface of the main body. The slip guard can function to prevent the musical instrument from sliding off of the main body during use.

Yet another embodiment of the present invention can include a neck support that extends upward from the top surface of the main body at a location adjacent to the proximal end. The neck support can function to cradle the neck of a guitar when the device is placed onto a flat surface.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
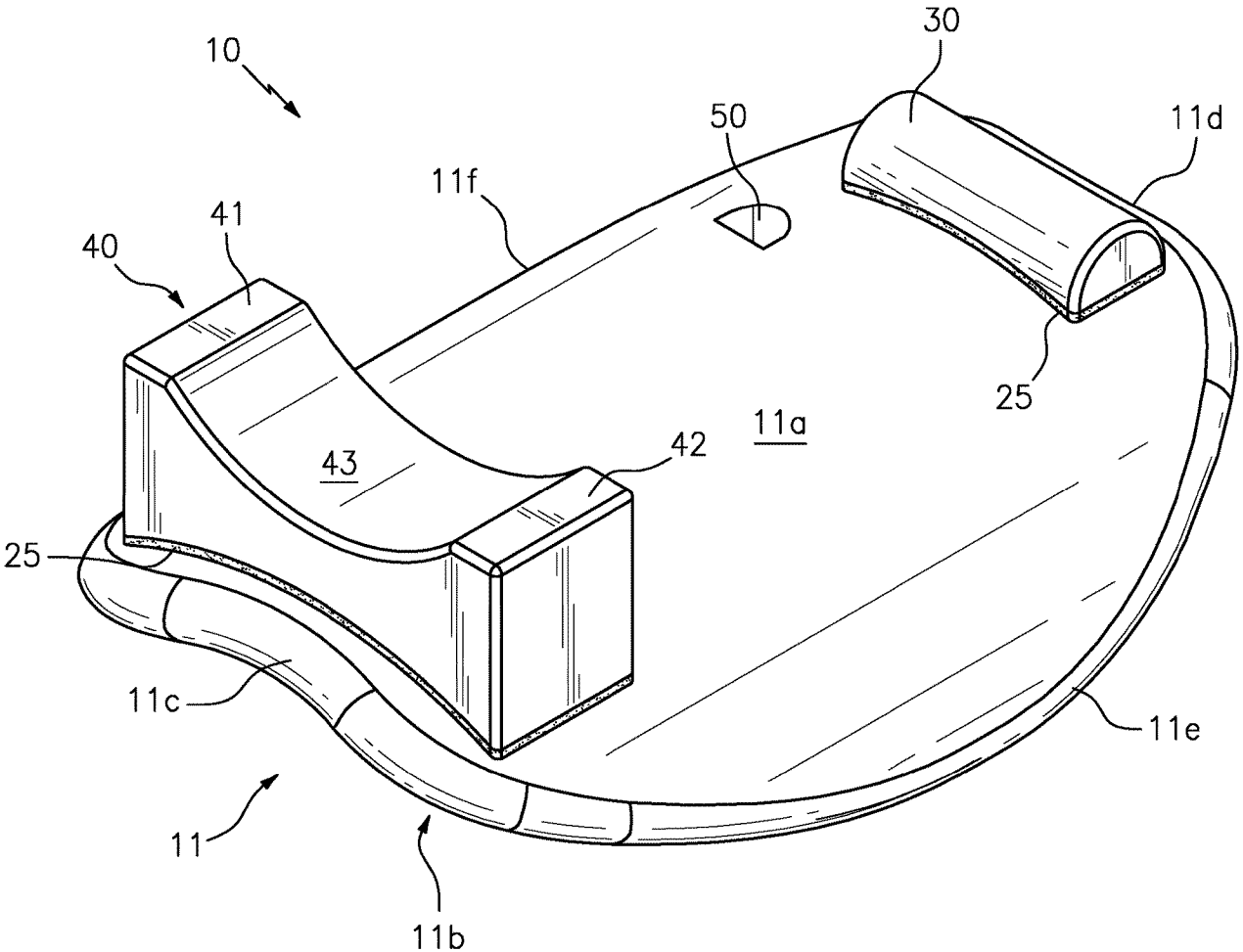
FIG. 1 is a perspective view of an instrument cushion and support device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although described and illustrated for use with a guitar, this is for illustrative purposes only, as those of skill in the art will recognize that the inventive concepts disclosed herein can be used in conjunction with any number of other instruments. As such, the device is not to be construed as limiting. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors 25 such as opposing strips of hook and loop material (i.e. Velcro®), magnetic elements, and/or compression fittings such as hooks, snaps and buttons, for example. Moreover, the term "permanently secured" shall be used to describe a situation wherein two or more objects are joined together in a manner so as to prevent the same objects from being separated. Several nonlimiting examples include various adhesives such as glue or resin, and/or through the use of tape, for example.

FIG. 1 illustrates one embodiment of an instrument cushion and support device 10 that is useful for understanding the inventive concepts disclosed herein. As shown, the device 10 can include, essentially, a main body 11 having one or both of a slip guard 30 and a neck support 40.

In various embodiments, the main body 11 can include an elongated member having a curved top surface 11*a*, a curved bottom surface 11*b*, a proximal end 11*c*, a distal end 11*d* and a pair of curved opposing sides 11*e* and 11*f* that extend between the distal and proximal ends. As shown, the distal end 11*d* can preferably be tapered so as to include an overall width that is less than the proximal end 11*c*. Moreover, the curve in the bottom and top surfaces can extend upward from the bottom end to the top end. Such a shape forming a bend that conforms to the shape of an upper portion of any user's right or left thigh (See FIG. 3).

Figure 2:
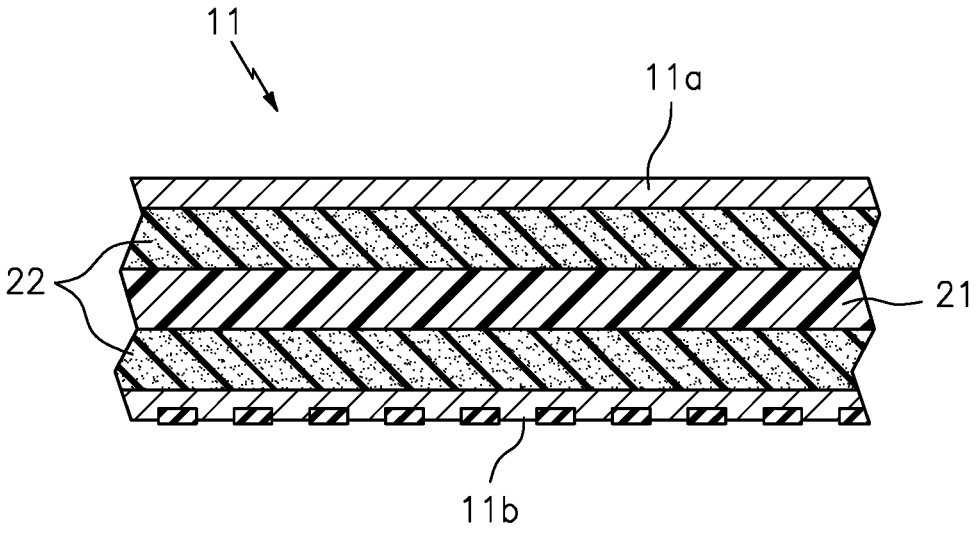
FIG. 2 is a partial cutout cross section view of a layered construction of the main body of the instrument cushion and support device, in accordance with one embodiment of the invention.

In the preferred embodiment, the main body 11 can include a layered construction, wherein each layer performs a different and specific function. As illustrated in cross sectional FIG. 2, the main body 11 can preferably include a rigid central core 21, and padded middle layers 22, that are interposed between the top and bottom surfaces 11*a* and 11*b*, respectively.

The central core 21 can be constructed from any number of lightweight rigid materials such as injection molded plastic, or PVC, for example. The central core can function to maintain the main body 11 in the above described shape so the same does not become deformed when the weight of a musical instrument is placed thereon. Of course, any number of other lightweight rigid materials can also be utilized herein.

The middle layer 22 can be located between the core 21 and the outside facing surfaces 11*a* and 11*b*. In the preferred embodiment, the middle layer can include or comprise a cushioning material, such as Styrofoam, high density foam, high resilience foam, Polyurethane, memory foam, closed cell foam, and/or open cell foam, for example. The middle layer can function to provide a soft resting place for a musical instrument, and can be secured onto the central core in accordance with known construction methodologies such as various adhesives or double sided tape, among others, for example.

The top surface 11*a* can preferably include or comprise any type of soft fabric materials such as cotton, satin, or wool, for example, that are non-abrasive. Such a material can function to protect the delicate finish of the instrument and to reduce slipping of the same during device operation.

The bottom surface 11*b* can preferably include, comprise and/or be lined with a non-slip material such as rubber, for example, that has a high coefficient of friction. Such a material can function to prevent the main body 11 from sliding when the same is placed onto a user's thigh and/or a flat surface such as a table, for example. Of course, the bottom surface 11*b* can also be constructed from an identical material as the top surface 11*a*, so as to allow both the top and bottom surfaces to be constructed from a single piece of material.

Although described above with respect to a particular shape and material, this is for illustrative purposes only. To this end, those of skill in the art will recognize that the main body 11 can be constructed to include any number of different shapes and sizes, and can further include any number of different layers and/or materials, without limitation.

In various embodiments, the device 10 can also include a slip guard 30 which can preferably extend upward from the top surface 11*a* of the main body at a location adjacent to the distal end 11*d*. Although illustrated as a generally tubular-shaped member, the slip guard can include any number of different shapes, heights and widths between the opposing sides 11*e* and 11*f*.

In the preferred embodiment, the slip guard can be constructed from an identical material as the above described cushioned layer 22 and/or core member 21, and can be formed integrally therewith, so as to be covered by the top layer 11*a*. Of course, the slip guard can also be constructed as a separate component that is secured to the top surface 11*a* in a permanent manner or in a removable manner via connectors 25 such as hook and loop elements, for example (see FIG. 5). As such, the slip guard 30 can include or comprise any number of different shapes, materials and/or manufacturing processes.

Figure 3:
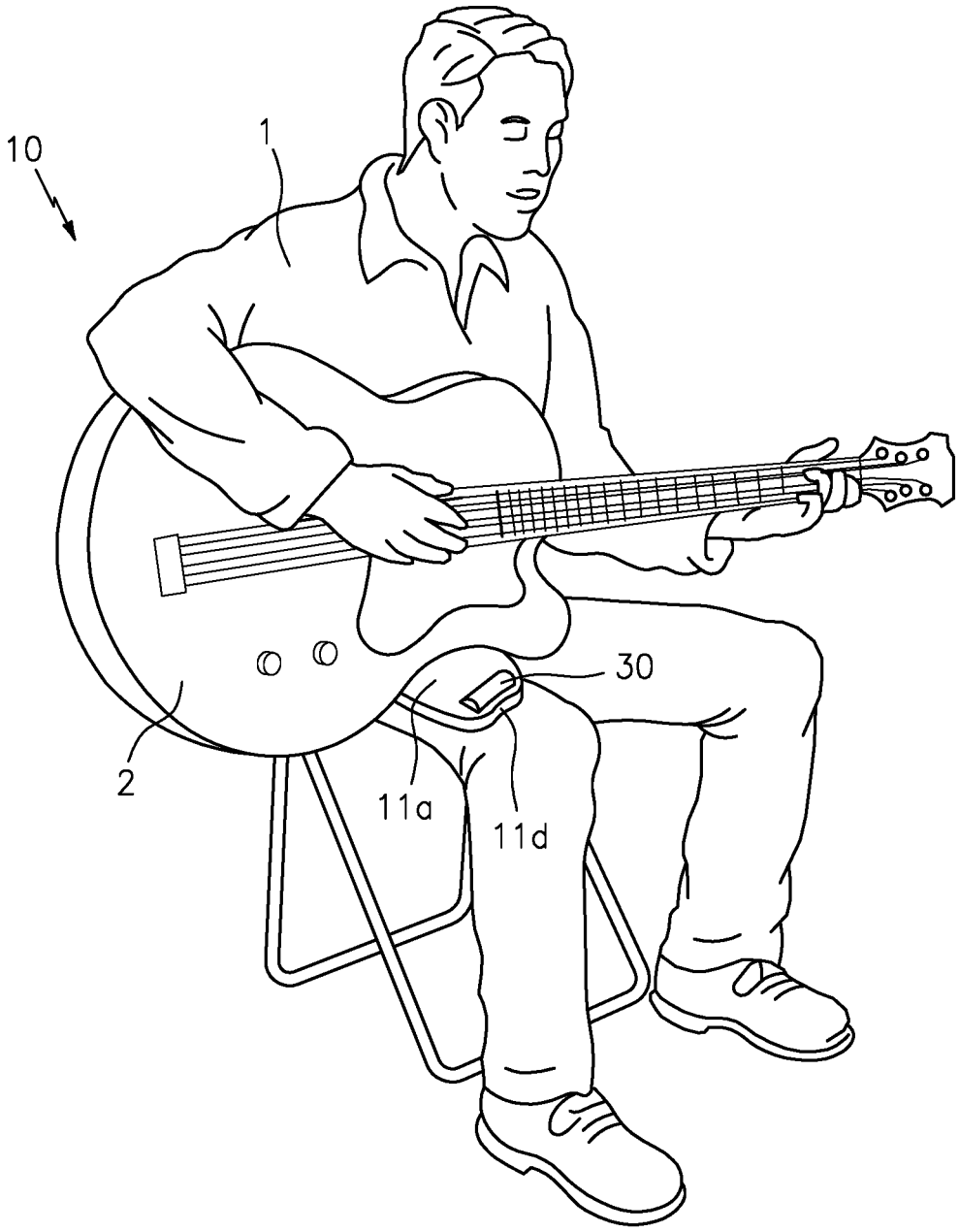
FIG. 3 is a perspective view of the instrument cushion and support device, in operation, in accordance with one embodiment of the invention.

As shown in FIG. 3, the device 10 is intended to be placed onto the leg of a user 1, so as to receive a musical instrument 2. When so used, the soft nature of the device can cushion the instrument and distribute the weight of the same across a large area of the user's leg. Moreover, as the user's leg is typically at a downward angle while in this position, the slip guard 30 can function to prevent the instrument 2 from sliding off the top surface 11*a* during play.

In various embodiments, the device 10 can also include a neck support 40 which can extend upward from the top surface 11*a* of the main body at a location adjacent to the proximal end 11*c*. As shown, the neck support can preferably include a pair of raised elements 41 and 42 that are connected by a generally curved middle section 43. The curve of the middle section 43 being generally opposite to the curve of the main body 11, so as to form a cradle for receiving the neck of a guitar.

In the preferred embodiment, the neck support 40 can also be constructed from an identical material as the above described cushioned layer 22 and/or core member 21, so as to be formed as an integral component thereof before being covered by the top layer 11*a*. Of course, the neck support can also be constructed as a separate component that is secured to the top surface 11*a* in a permanent manner or in a removable manner (see FIG. 5) via connectors 25 such as hook and loop elements, for example. As such, the neck support 40 can include or comprise any number of different shapes, materials and/or manufacturing processes.

Figure 4A:
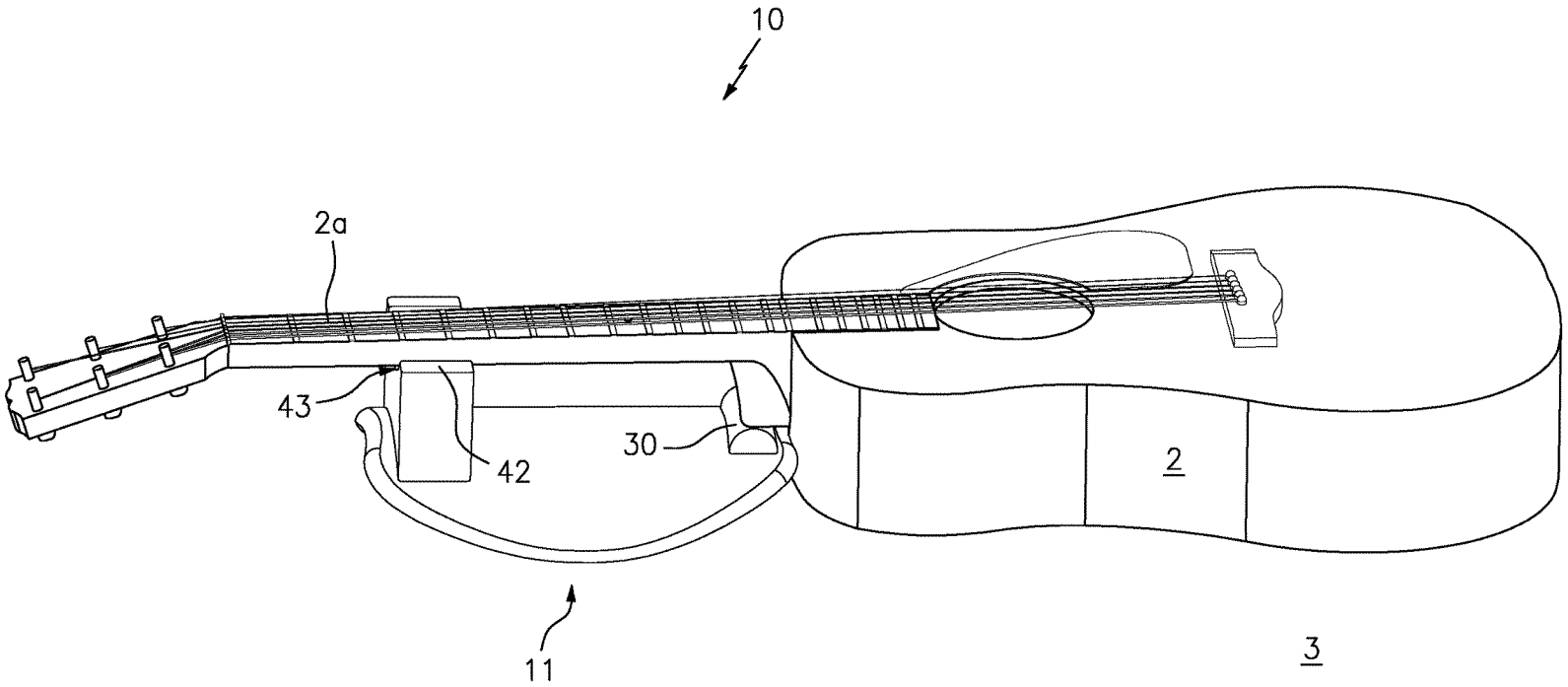
FIG. 4A is another perspective view of the instrument cushion and support device, in operation, in accordance with one embodiment of the invention.

As shown in FIG. 4A, the device 10 can be utilized to securely receive and position a musical instrument 2 when the same is not being played. When so used, the main body can be positioned onto a table 3 or other flat surface. Next, a user can simply place the neck 2*a* of the guitar into curved middle section 43 of the neck support and rest the body of the guitar on the table. Owing to the non-skid bottom layer 11*b*, the device will remain stable and will not slide; therefore ensuring the guitar remains in a stable condition while not being played. Such a feature also allows a user to position the guitar in a completely horizontal position with little to no stress on the neck of the instrument. Moreover, owing to the rigid construction of the central core 21, the device 10 will not flex if/when a user imparts a downward pressure onto the neck of the guitar as often happens while changing the strings or other such components.

Figure 4B:
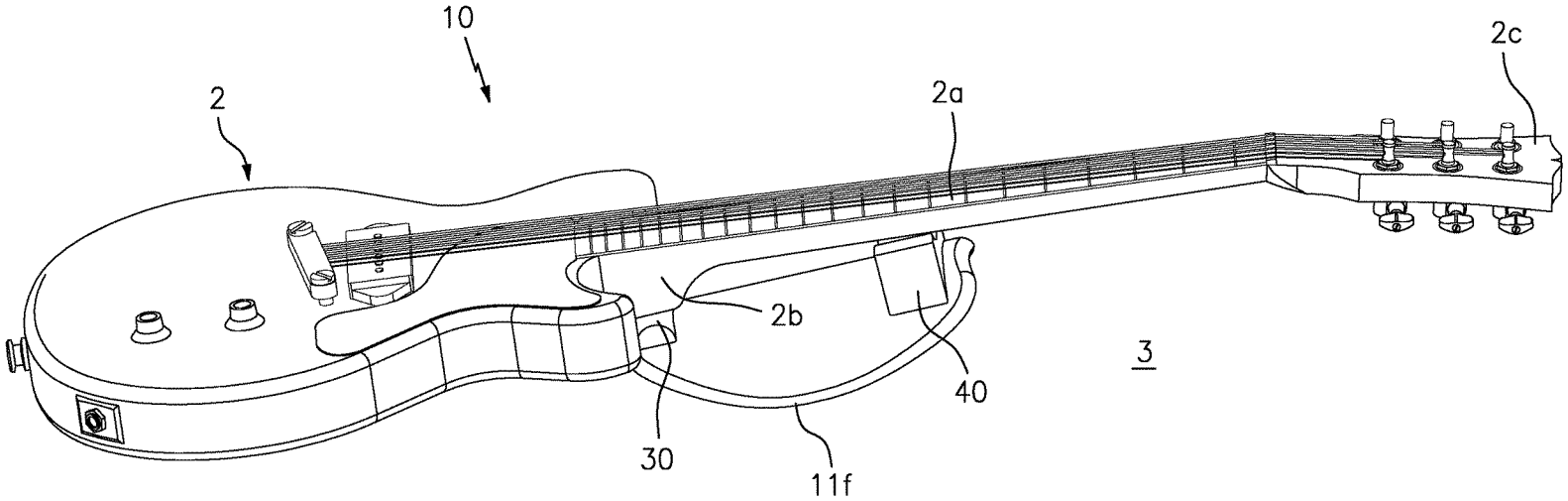
FIG. 4B is yet another perspective view of the instrument cushion and support device, in operation, in accordance with one embodiment of the invention.

In addition to the above, the rigid nature of the main body along with the curved shape of the opposing sides 11*e* and 11*f*, allow the main body to rock/pivot along the axis extending from the proximal end to the distal end. As shown in FIG. 4B, this feature can be utilized wherein the heel 2*b* of the guitar can be placed onto the slip guard 30, thereby causing the proximal end 11*c* and the neck support 40 to pivot upwards until making contact with the neck of the guitar 2*a*. When in this position, the guitar 2 can be fully supported with the headstock 2*c* positioned above (see arrow a) the flat surface 3. Such a feature is particularly advantageous for providing a user with room to use a string winder or other such component, without having to manually lift and hold the headstock away from the surface.

Figure 5:
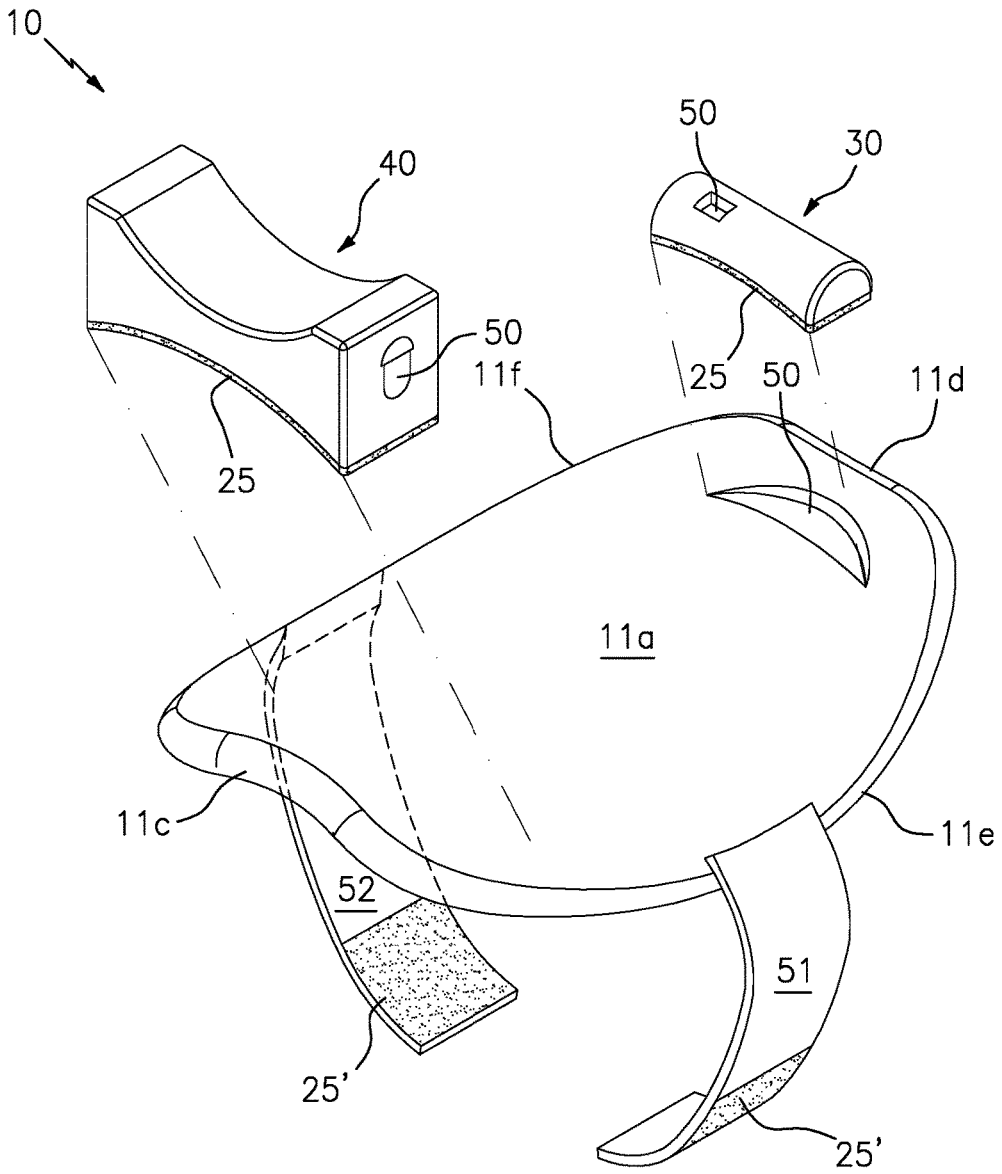
FIG. 5 is another perspective view of an instrument cushion and support device, in accordance with one embodiment of the invention.

As shown in FIG. 5, the device 10 can also include any number of different pockets 50 having any number of different shapes and sizes. The pockets can be located anywhere along one or more of the main body 11, the slip guard 30 and/or the neck support 40, for example, and can function to receive and store any number of different items such as guitar picks, cleaning cloths and the like, for example. Additionally, the device can also include one or more leg straps 51 and 52, for example, each having a connector 25' such as opposing strips of hook and loop material which can function to allow a user to secure the device onto their leg during use.

Accordingly, the above described instrument cushion and support device 10 provides a multifaceted solution to many problems commonly experienced by musicians. While the dimensions of the elements are not critical, in the preferred embodiment the main body can include a length (e.g., distance between proximal end 11*c* and distal end 11*d*) of approximately 7.5 inches, and a width (e.g., distance between sides 11*e* and 11*f*) of approximately 6.25 inches.

In the preferred embodiment, the slip guard can extend approximately 0.5 inches above the top surface 11*a*, and the middle portion of the neck support can extend approximately 2.5 inches above a flat surface 3, so as to match the height of the neck of a typical acoustic guitar when the body portion of the same guitar is resting on the same surface. Of course, these dimensions are exemplary in nature, as other embodiments are contemplated having any number of different dimensions.

As described herein, one or more elements of the instrument cushion and support device 10 can be secured together utilizing any number of known attachment means. Moreover, although the above embodiments have been described as including separate individual elements, the inventive concepts disclosed herein are not so limiting. To this end, one of skill in the art will recognize that one or more individually identified elements such as the main body 11, the slip guard 30 and/or the neck support 40, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An instrument cushion and support device, comprising:

an elongated main body having a curved top surface, a curved bottom surface, a proximal end and a distal end, said curved bottom surface being configured to rest on a human thigh;

a rigid central core that is disposed between the curved top and bottom surfaces;

a cushioned middle layer that is disposed between the rigid central core and each of the curved top and bottom surfaces;

a slip guard that extends upward from the curved top surface, said slip guard being located adjacent to the distal end; and a neck support that extends upward from the top surface of the main body at a location adjacent to the proximal end, said neck support including first and second raised elements that are connected by a curved middle section that is oriented inversely to the curved top and bottom surfaces of the main body.

2. The device of claim 1, wherein the curved bottom surface includes a non-skid material.

3. The device of claim 1, wherein the top surface is constructed from a soft, non-abrasive material.

4. An instrument cushion and support device, comprising:

an elongated main body having a curved top surface, a curved bottom surface, a proximal end and a distal end, said curved bottom surface being configured to rest on a human thigh;

a rigid central core that is disposed between the curved top and bottom surfaces;

a cushioned middle layer that is disposed between the rigid central core and each of the curved top and bottom surfaces; and a neck support that extends upward from the top surface of the main body at a location adjacent to the proximal end, said neck support including first and second raised elements that are connected by a curved middle section that is oriented inversely to the curved top and bottom surfaces of the main body.

5. The device of claim 4, wherein the curved bottom surface includes a non-skid material.

6. The device of claim 4, wherein the top surface is constructed from a soft, non-abrasive material.

* * * * *